US008430685B2

(12) United States Patent
Brekosky et al.

(10) Patent No.: US 8,430,685 B2
(45) Date of Patent: Apr. 30, 2013

(54) CONNECTOR ASSEMBLY

(75) Inventors: Lawrence John Brekosky, Dillsburg, PA (US); Keith Edwin Miller, Manheim, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/190,373

(22) Filed: Jul. 25, 2011

(65) Prior Publication Data

US 2013/0029502 A1 Jan. 31, 2013

(51) Int. Cl.
*H01R 12/24* (2006.01)

(52) U.S. Cl.
USPC ..... 439/495

(58) Field of Classification Search ..... 439/260, 439/492, 493, 495, 496, 499, 494
See application file for complete search history.

(56) References Cited

U.S. PATENT DOCUMENTS

| | | | | |
|---|---|---|---|---|
| 3,696,319 | A * | 10/1972 | Olsson | 439/496 |
| 4,701,002 | A * | 10/1987 | Mouissie | 439/426 |
| 4,734,053 | A | 3/1988 | Imai | |
| 5,240,430 | A * | 8/1993 | Soes | 439/260 |
| 5,738,545 | A * | 4/1998 | Igarashi et al. | 439/607.36 |
| 5,842,883 | A * | 12/1998 | Igarashi et al. | 439/495 |
| 5,906,504 | A * | 5/1999 | Igarashi et al. | 439/495 |
| 5,928,029 | A * | 7/1999 | Lam | 439/497 |
| 6,171,137 | B1 * | 1/2001 | Hatakeyama | 439/495 |
| 6,231,378 | B1 * | 5/2001 | Wu et al. | 439/495 |
| 6,238,238 | B1 * | 5/2001 | Hwang et al. | 439/495 |
| 6,280,239 | B1 * | 8/2001 | Cheng | 439/495 |
| 6,332,801 | B1 * | 12/2001 | Watanbe | 439/409 |
| 6,358,061 | B1 * | 3/2002 | Regnier | 439/60 |
| 6,464,521 | B1 * | 10/2002 | Kurotori et al. | 439/260 |
| 6,508,661 | B1 * | 1/2003 | Yu | 439/495 |
| 6,561,843 | B1 * | 5/2003 | Ma et al. | 439/495 |
| 6,626,698 | B2 * | 9/2003 | Matsumura | 439/496 |
| 6,722,915 | B1 * | 4/2004 | McAlonis et al. | 439/498 |
| 6,837,740 | B2 * | 1/2005 | Kunishi et al. | 439/495 |
| 6,854,995 | B2 * | 2/2005 | Hotea | 439/260 |
| 6,997,729 | B2 * | 2/2006 | Sunaga | 439/260 |
| 7,052,300 | B2 * | 5/2006 | Okita et al. | 439/260 |
| 7,059,893 | B2 * | 6/2006 | Ono et al. | 439/495 |
| 7,114,988 | B2 * | 10/2006 | Sato et al. | 439/492 |
| 7,137,838 | B2 * | 11/2006 | Koga | 439/260 |
| 7,140,896 | B2 * | 11/2006 | Takai et al. | 439/260 |
| 7,275,954 | B2 * | 10/2007 | Ikenaga et al. | 439/494 |
| 7,467,970 | B2 * | 12/2008 | Ikuta et al. | 439/496 |
| 7,488,198 | B2 * | 2/2009 | Shiu et al. | 439/495 |
| 7,604,499 | B2 * | 10/2009 | Sunaga | 439/495 |
| 7,909,630 | B2 * | 3/2011 | Yamada | 439/260 |

(Continued)

*Primary Examiner* — Ross Gushi

(57) ABSTRACT

A connector assembly includes an insertion member that includes a plurality of contact pads, and a housing that defines an opening at a first end configured to receive the insertion member. The upper inside surface and lower inside surface of the housing define a plurality of slots into which are placed electrical contacts. Each electrical contact includes a cross-member, a first and a second extension member, a resilient member, and a mating extension. The first and second extension members extend from respective ends of the cross-member and are positioned within respective slots of the housing. The resilient member extends from the cross member from a position between the first and the second extension members. A mating extension extends from the other side of the cross-member and through an opening defined in the rear wall of the housing. The resilient member is configured to make electrical contact with a contact pad of the insertion member.

9 Claims, 15 Drawing Sheets

U.S. PATENT DOCUMENTS

| | | | | |
|---|---|---|---|---|
| 8,128,425 | B2 * | 3/2012 | Takahashi et al. | 439/260 |
| 2003/0096530 | A1 * | 5/2003 | Ma et al. | 439/495 |
| 2003/0104721 | A1 * | 6/2003 | Yu | 439/495 |
| 2003/0157829 | A1 * | 8/2003 | Kunishi et al. | 439/495 |
| 2004/0067679 | A1 * | 4/2004 | Maejima | 439/495 |
| 2005/0255732 | A1 * | 11/2005 | Sunaga | 439/260 |
| 2006/0110965 | A1 * | 5/2006 | Koga | 439/260 |
| 2006/0178039 | A1 * | 8/2006 | Chen | 439/495 |
| 2007/0066127 | A1 * | 3/2007 | Inoue | 439/495 |
| 2007/0141897 | A1 * | 6/2007 | Miura et al. | 439/495 |
| 2008/0009180 | A1 * | 1/2008 | Ikuta et al. | 439/495 |
| 2008/0254662 | A1 * | 10/2008 | Koga | 439/260 |
| 2010/0184317 | A1 * | 7/2010 | Sunaga | 439/260 |

* cited by examiner

CONNECTOR ASSEMBLY

BACKGROUND

Electrical connectors are utilized in a variety of applications to couple a first group of conductors to a second group of conductors so as to complete an electrical circuit. For example, a medical catheter device may include a group of conductors. Individual contacts may be soldered to the conductors. The connectors may then be connected to a second group of conductors originating from a piece of monitoring equipment. To prevent the circuits from shorting, the connectors for the respective conductors may be spaced apart after being connected and covered by an epoxy. The hardened epoxy serves as an insulator and prevents the connectors from moving or from becoming disconnected.

Assembly of the connector, however, is time consuming as there may be a large number of conductors that have to be connected.

BRIEF SUMMARY

An object of the invention is to provide a connector assembly that overcomes the assembly problems above. The connector assembly includes an insertion member that includes a plurality of contact pads, and a housing that defines an opening at a first end configured to receive the insertion member. The upper inside surface and lower inside surface of the housing define a plurality of slots into which are placed electrical contacts. Each electrical contact includes a cross-member, a first and a second extension member, a resilient member, and a mating extension. The first and second extension members extend from respective ends of the cross-member and are positioned within respective slots of the housing. The resilient member extends from the cross member from a position between the first and the second extension members. The mating extension extends from the other side of the cross-member and through an opening defined in the rear wall of the housing. The resilient member is configured to make electrical contact with a contact pad of the insertion member.

In another embodiment, the invention provides an electrical contact for a connector assembly comprising a cross-member; a first extension member and a second extension member that extend from a first end and a second end, respectively, of the cross-member; a resilient member that extends from a first side of the cross-member, between the first and the second extension members, the resilient member being configured to make electrical contact with a contact pad of a circuit; and a mating extension that extends from a second side of the cross-member that is opposite the first side.

Other features and advantages will be, or will become, apparent to one with skill in the art upon examination of the following figures and detailed description. It is intended that all such additional features and advantages included within this description be within the scope of the claims, and be protected by the following claims.

BRIEF DESCRIPTION OF THE DRAWINGS

The accompanying drawings are included to provide a further understanding of the claims, are incorporated in, and constitute a part of this specification. The detailed description and illustrated embodiments described serve to explain the principles defined by the claims.

DETAILED DESCRIPTION OF THE DRAWINGS

Figure 1:
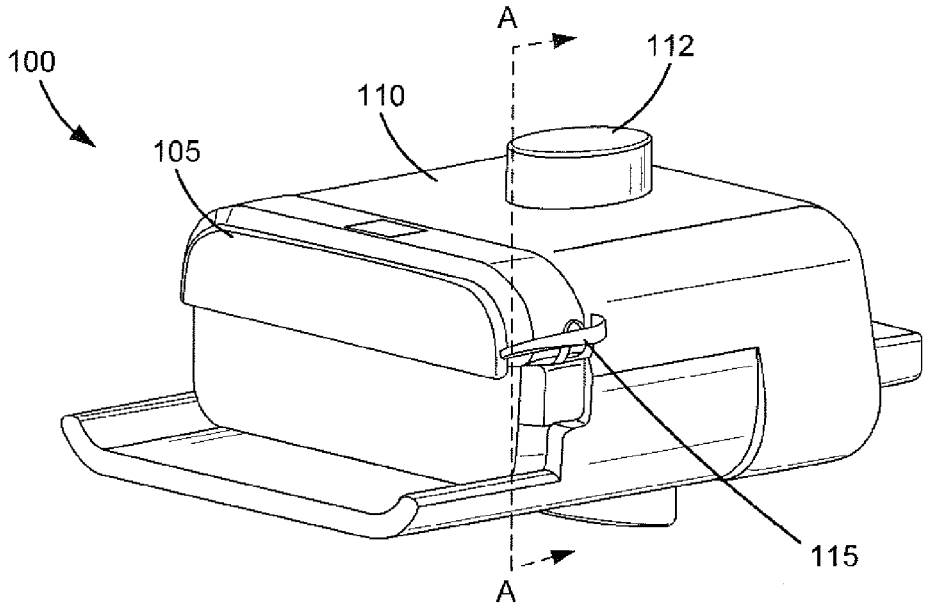
FIGS. 1 and 2 illustrate front and rear perspective views, respectively, of a first embodiment of a connector assembly.
Figure 2:
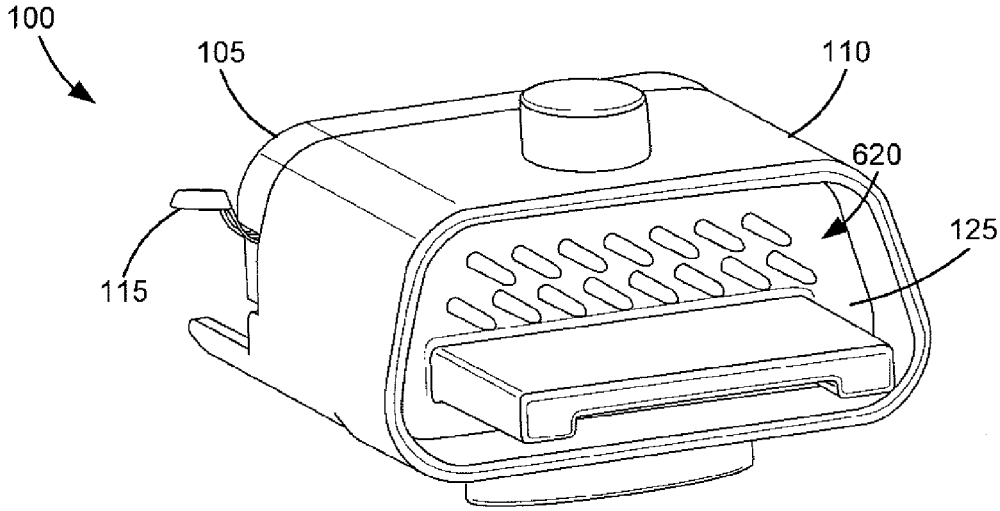

FIGS. 1 and 2 illustrate front and rear perspective views, respectively, of a first embodiment of a connector assembly 100. The connector assembly 100 includes an insertion member 105, and a housing 110. The insertion member 105 is selectably insertable within the housing 110. In other words, the insertion member 105 may be inserted and removed by a user. In some implementations, the insertion member 105 is selectably maintained within the housing 110 via friction. In other implementations, respective locking features, such as tabs, grooves, latches, and the like may positioned on the insertion member 105 and housing 110 and configured to maintain the insertion member 105 within the housing 110. In yet other implementations glue, straps, and the like may be utilized to permanently maintain the insertion member 105 within the housing 110.

The insertion member 105 and the housing 110 cooperate to couple a first group of conductors 115, such as wires, flex strips or conductive materials known in the art, to a group of mating extensions 620 that extend from a rear wall 125 of the rear end of the housing 110. The group of conductors 115 may originate, for example, from an end of a medical catheter. In some implementations, the rear end of the housing is configured to be connected or mated to another connector (not shown). In other implementations, conductors (e.g., wires) may be attached (e.g., soldered) to the mating extension 620. For example, the mating extension 620 may correspond to a tab suited for soldering of wires. In some implementations, a boss 112 may extend from a top side of the housing. The boss 112 enables positioning of the connector assembly 100 in a mold for forming an over-mold layer over the entire connector assembly 100 after the connector assembly 100 is fully assembled to provide a hygienic connector suitable for a medical operating room.

Figure 3:
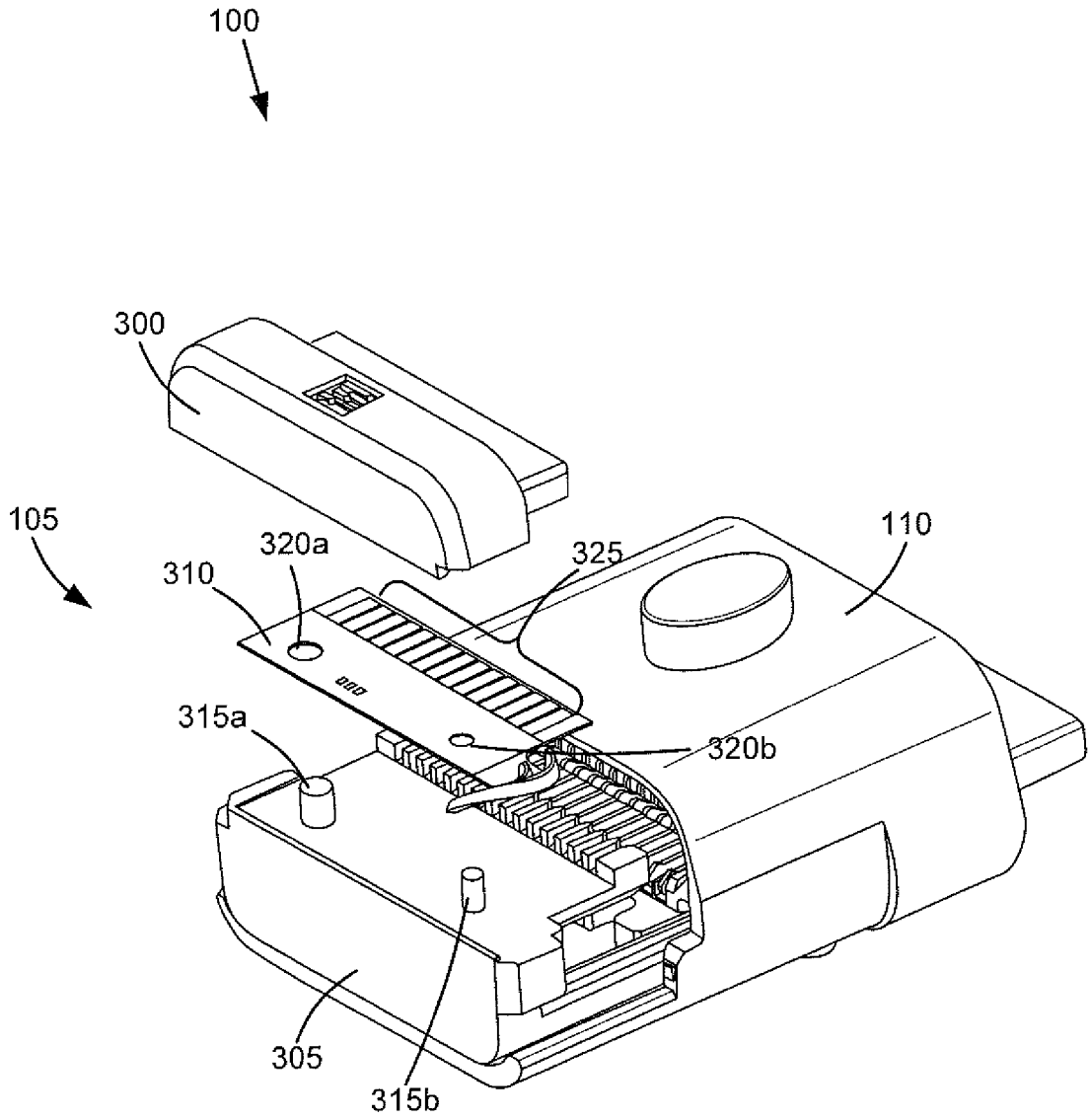
FIG. 3 illustrates a partially exploded view of the first embodiment of the connector assembly.

FIG. 3 illustrates a partially exploded view of the first embodiment of the connector assembly 100. Referring to FIG. 3, the insertion member 105 includes an upper portion 300, a lower portion 305, and a circuit 310. The circuit 310 is positioned between the upper portion 300 and the lower portion 305. The lower portion 305 may include one or more locating features 315*a* and 315*b* such as alignment posts and the upper portion 300 may define one or more complementary locating features such as openings (not shown) sized to receive the locating features of the lower portion 315*a* and 315*b*. The form of the locating features may correspond to any suitable means for aligning components. The circuit 310 may define locating features 320*a* and 320*b* such as one or more openings through which the locating features 315*a* and 315*b* of the lower portion 305 extend when the insertion member 105 is assembled. The locating features 315*a* and 315*b* of the lower portion 305 and locating features of the circuit 310 cooperate to predictably align the circuit 310 within the insertion member 105. In some implementations, the respective locating features are configured such that the upper portion 300 and lower portion 305 are non-separable after being joined. For example, the upper portion 300 and lower portion 305 may be glued together or snap-fitted.

The circuit 310 may correspond to a planar circuit board. The circuit 310 includes one or more contact pads 325. The circuit 310 may include one or more traces for electrically coupling the contact pads 325 to the first group of conductors 115, described above. The contact pads may be positioned on one side of the circuit 310 (e.g., the upper surface). In some implementations, the circuit 310 corresponds to a flexible circuit board. The flexible circuit board may include a region upon which the contact pads 325 are positioned. The flexible circuit may also include a "tail" portion where electrical traces from the contact pads are brought together. The "tail" may perform the function of the group of conductors 115 and may extend to a termination point of the catheter described above.

Figure 4:
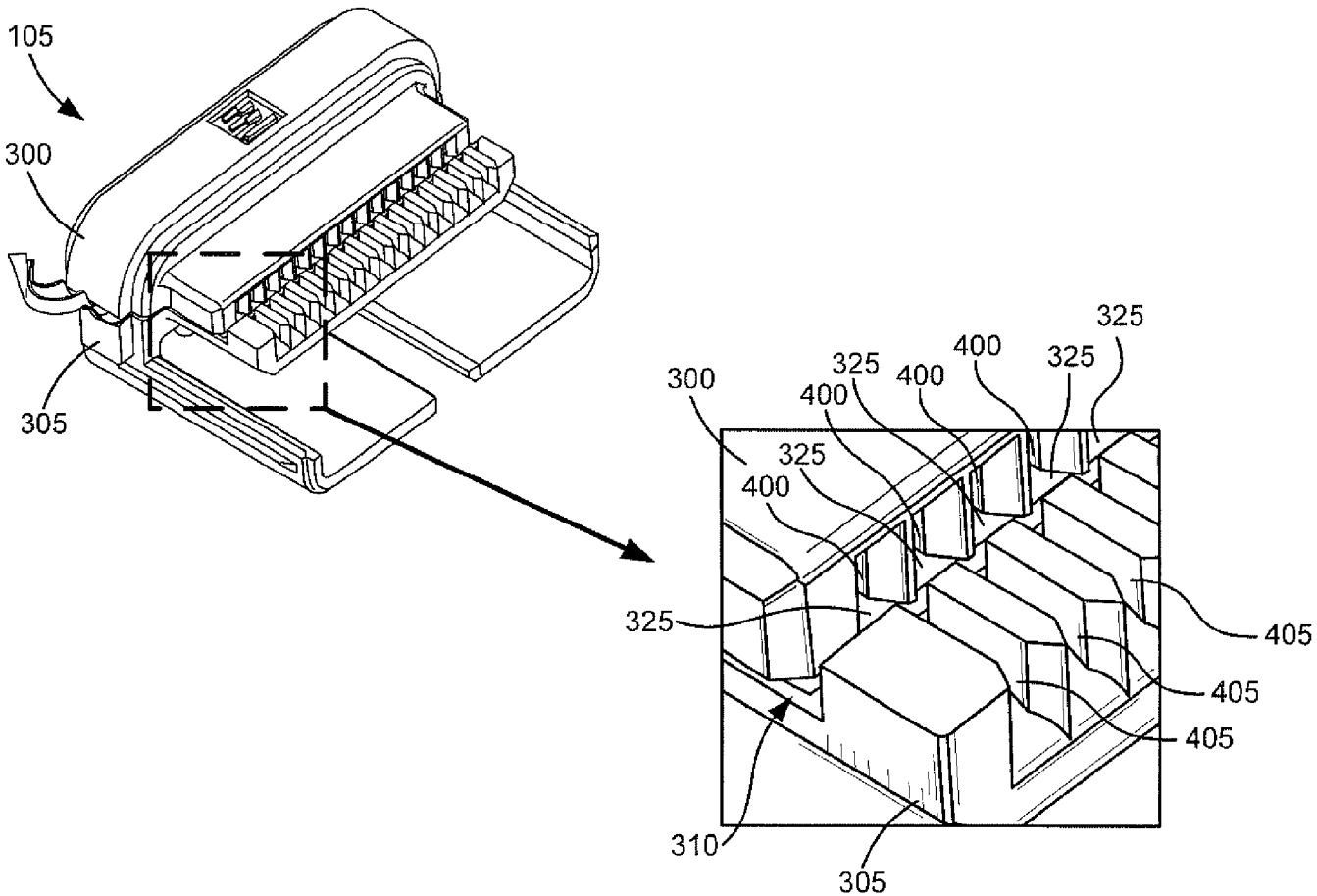
FIG. 4 illustrates features of an insertion member of the first embodiment of the connector assembly.

Referring to FIG. 4, the upper portion 300 and the lower portion 305 of the insertion member 105 define a plurality of guides 400 and 405. Each guide 400 of the upper portion 300 is in-line with a respective guide 405 of the lower portion 305. Each of the guides 400 and 405 is also in line with a contact pad 325 of the circuit 310. The respective guides 400 and 405 are configured to ensure that a resilient member of an electrical contact (described below) of the housing 110 is positioned over a contact pad 325 positioned on the upper surface of the circuit 310 when the insertion member 300 is inserted into the housing 110.

In some implementations, forward edges of the respective guides 400 and 405 are tapered to accommodate positioning of resilient members that may not be perfectly centered with the centers of the respective guides 400 and 405.

Figure 5:
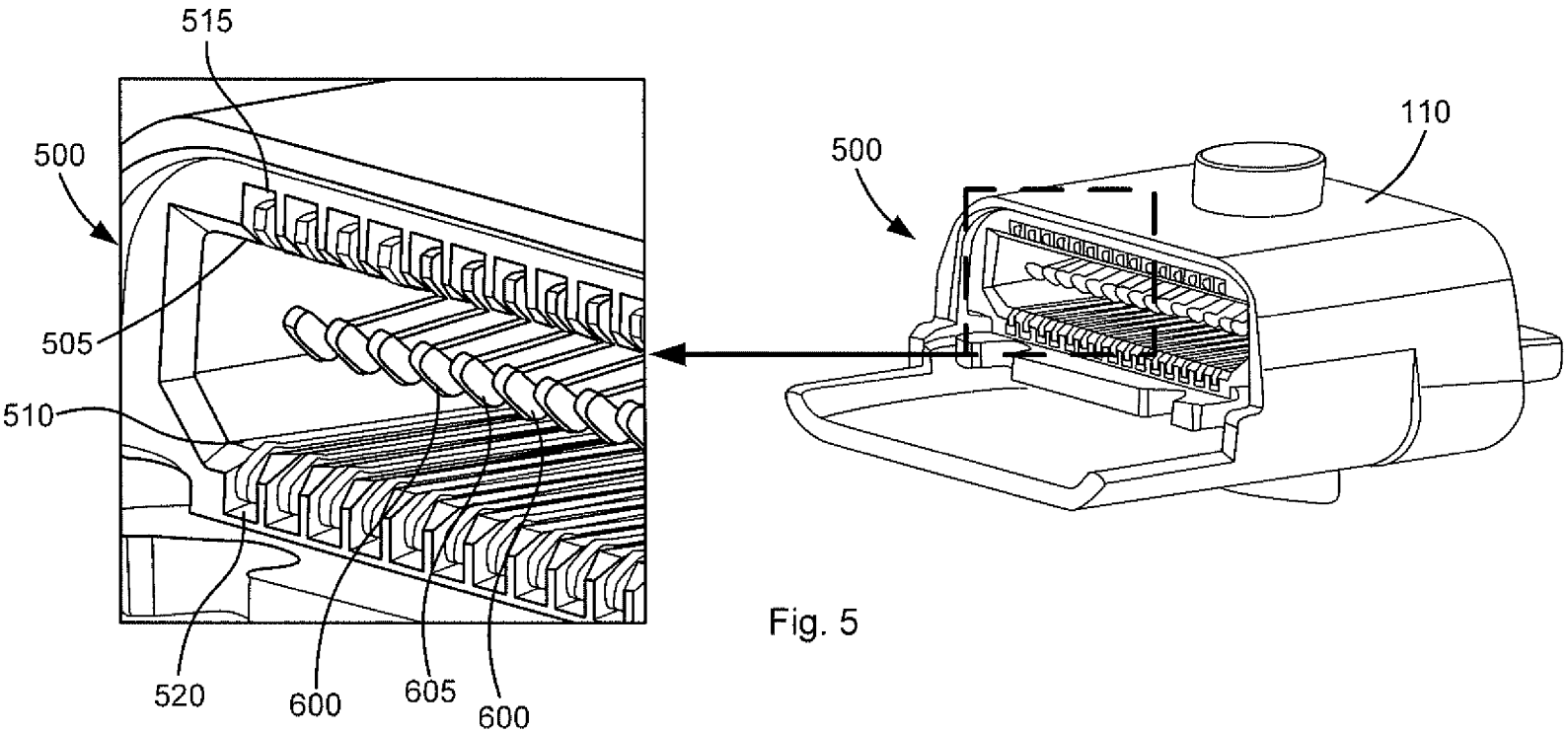
FIG. 5 illustrates electrical contacts positioned within a housing of the first embodiment of the connector assembly.

Referring to FIG. 5, the housing 110 defines an opening 500 at a first end. The opening 500 is sized to receive the insertion member 105 and to provide a snug fit with the insertion member 105. The inside geometry of the opening 500 is generally configured to match the outside geometry of the insertion member 105. An upper inside surface 505 and a lower inside surface 510 of the housing define a plurality of slots 515 and 520. The rear wall 125 (FIG. 2) of the housing 110 defines a plurality of openings through which mating extensions 620 of electrical contacts 600 and 605 (FIG. 6) extend, as shown in FIG. 2. The openings and mating extensions 620 may be arranged in a first and a second row and may be evenly spaced apart from adjacent openings and mating extensions 620 and/or evenly distributed over the rear wall 125. In some implementations, the mating extensions 620 and openings in the first row are staggered in relation to the mating extensions 620 and openings in the second row.

The electrical contacts 600 and 605 (FIG. 6) are positioned adjacent to one another in the opening 500 at the first end of the housing 110. The electrical contacts 600 and 605 are of either a first configuration 600 or a second configuration 605. The electrical contacts 600 and 605 may be arranged so the electrical contacts 600 and 605 alternate between the first configuration 600 and the second configuration 605.

Figure 6:
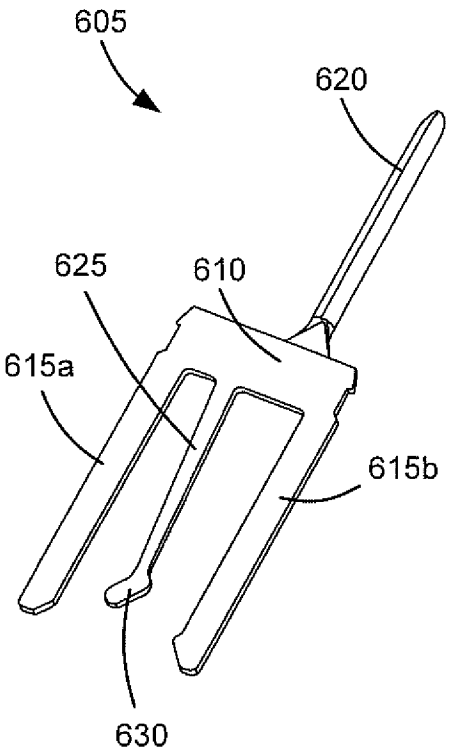
FIG. 6 illustrates first and second electrical contact configurations of the first embodiment of the connector assembly.
Figure 6:
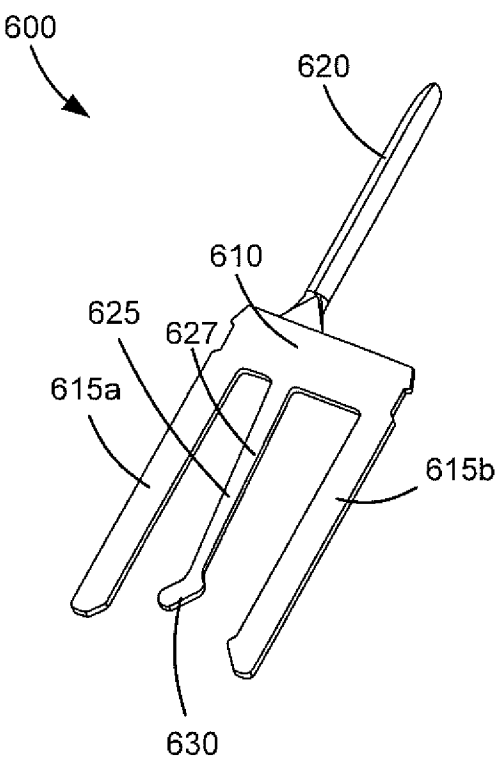

Referring to FIG. 6, each electrical contact 600 and 605 includes a cross-member 610, a first and a section extension member 615*a* and 615*b*, a resilient member 625, and a mating extension 620. The first and the second extension members 615*a* and 615*b* extend from a first end and a second end, respectively, of the cross-member 610. In some implementations, the first and the second extension members 615*a* and 615*b* are parallel to one another and extend in a direction that is generally perpendicular to a longitudinal axis of the cross-member 610. The respective extension members 615*a* and 615*b* are configured to be positioned within the slots 515 and 520 defined in the opening 500 of the housing 110.

Figure 7:
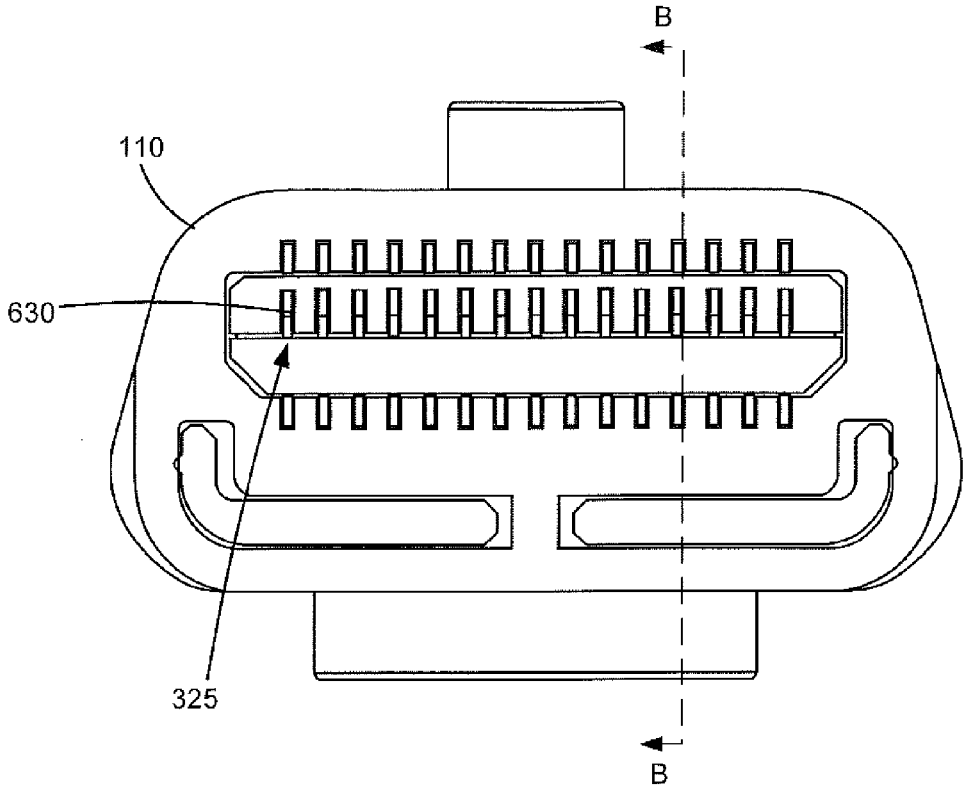
FIG. 7 illustrates a cross-section of the first embodiment of the connector assembly taken along section A-A of FIG. 1.
Figure 8:
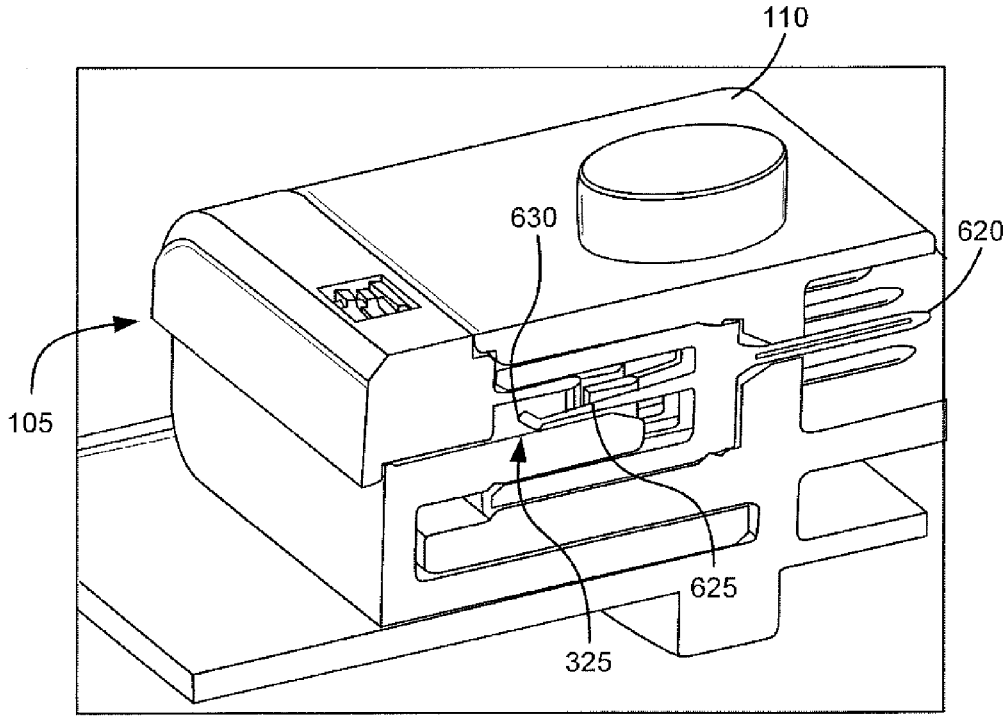
FIG. 8 illustrates a cross-section of the first embodiment of the connector assembly taken along section B-B of FIG. 7

The resilient member 625 extends from a first side of the cross-member 610 and is positioned between the first and the second extension members 615*a* and 615*b*. In some implementations, the resilient member 625 is offset towards one of the first and the second extension members 615*a* and 615*b* rather than centered between the two. In some implementations, the resilient member 625 includes a generally straight portion 627 and a tip portion 630. The straight portion 627 may be parallel to either of the first and the second extension members 615*a* and 615*b* or formed at an angle with respect to the respective extension members 615*a* and 615*b*. A tip portion 630 of the resilient member 625 may be formed at an angle relative to the straight portion 627 to enable the tip portion 630 of the resilient member 625 to "ride" over the contact pad 325 of the insertion member 105 to make electrical contact with the contact pad 325, as illustrated in FIGS. 7 and 8. For example, the angle formed between the tip portion 630 and the straight portion 627 may be an obtuse angle and the tip portion 630 may angle towards one of the first and the second extension members 615*a* and 615*b*. The resilient member 625 is configured so that the tip portion 630 will apply pressure against the contact pad when the insertion member 105 is inserted within the housing 110.

The mating extension 620 extends from the cross-member 610 from a side opposite to that of the resilient member 625. The mating extension may correspond to a pin configured to enter a complementary connector or a tab suitable for soldering wires. In a first configuration 600, the mating extension 620 may be offset towards the first extension member 615*a*. In a second configuration 605, the mating extension may be offset towards the second extension member 615*b*. This offset arrangement results in the first and second staggered rows of mating extensions shown in FIG. 2. That is, the first row of mating extensions may belong to electrical contacts of the first configuration 600 and the second row of mating extensions may belong to electrical contacts 605 of the second configuration, or vice versa.

The cross-member 610, first extension member 615*a*, second extension member 615*b*, resilient member 625 and mating extension 620 may be formed from a single planar sheet of conductive material. For example, the respective members may be stamped from a sheet of conductive material. In the case where the mating extension 620 corresponds to a pin, the pin may be formed by a rolling process or different process suitable for forming a planar material into a generally cylindrical shape.

Figure 9:
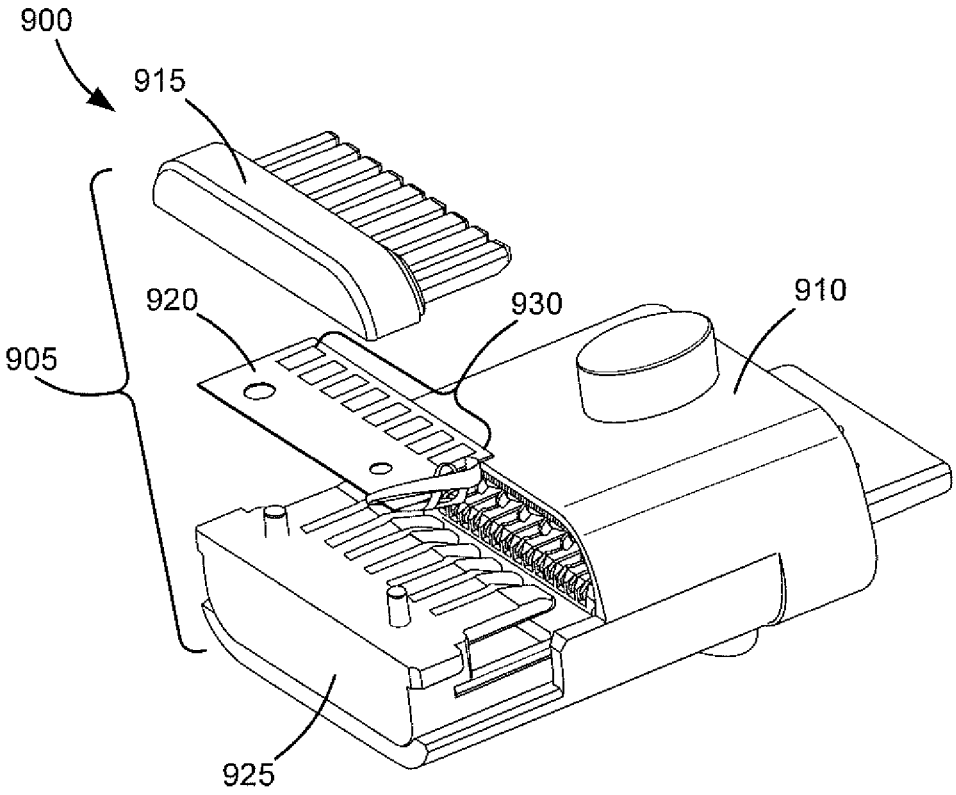
FIG. 9 is a partially exploded view of a second embodiment of a connector assembly.

FIG. 9 illustrates a partially exploded view of a second embodiment of a connector assembly 900. Shown is an insertion member 905 that includes an upper portion 915, a lower portion 925, a circuit 920, and a housing 910. The upper portion 915, lower portion 925, and circuit 920 may fit together in a similar manner as the upper and lower portions 300 and 305 and circuit 310 described above.

The circuit 920 may include features similar to the circuit 310 described above. However, in the second embodiment of the connector assembly 100, contact pads 325 may be positioned on both an upper and lower surface of the circuit 920. At least some of the contact pads 930 may be staggered in relation to one another. For example, one or more of the contact pads on the lower surface (not shown) may be positioned below or centered with a space defined between two adjacent contact pads 930 on the upper surface.

Figure 10:
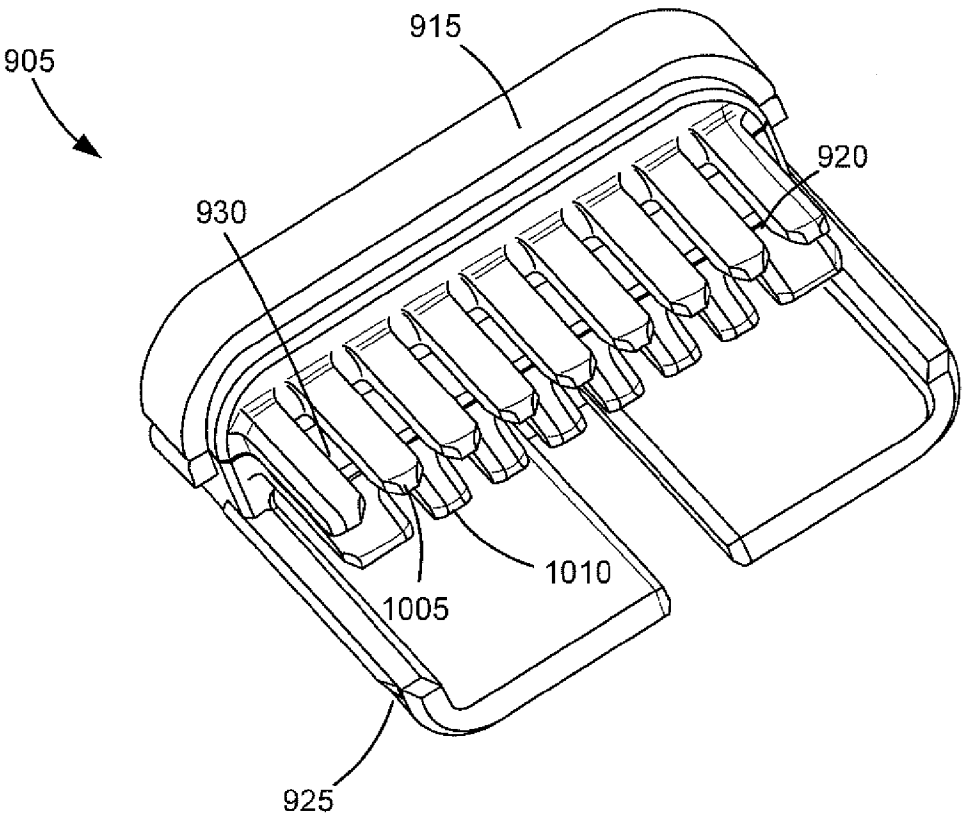
FIG. 10 illustrates features of an insertion member of the second embodiment of the connector assembly.

Referring to FIG. 10, the upper portion 915 and the lower portion 925 of the insertion member 905 may define a plurality of overlapping guides 1005 and 1010 that define a space there between configured to guide resilient members of electrical contacts, described below, over the contact pads 920 on the top surface of the circuit 920 and the contact pads (not shown) on the bottom surface of the circuit 920.

Figure 11:
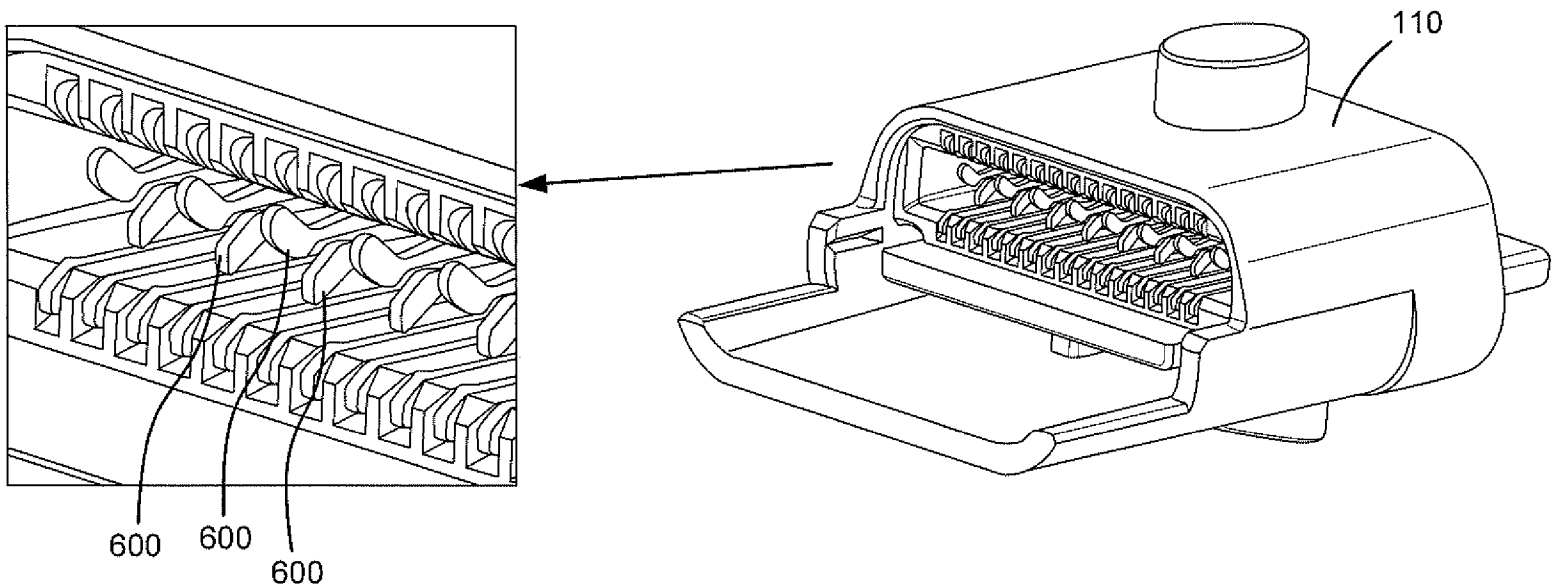
FIG. 11 illustrates electrical contacts positioned within a housing of the second embodiment of the connector assembly.

Referring to FIG. 11, the housing 110 may correspond to the housing 110 described above. However, in the second embodiment, the electrical contacts 600 may be of the same configuration. As noted above, in a given configuration 600, the mating extension 620 may be offset towards either the first extension member 615*a* or the second extension member 615*b*. Adjacent electrical contacts 600 are rotated 180 degrees relative to one another so that, for example, even numbered mating extensions extend through a first row of openings in the rear wall 125 of the housing 110, and odd numbered mating extensions extend through a second row of openings in the rear wall 125 of the housing to form the staggered mating extension pattern shown in FIG. 2.

Figure 12:
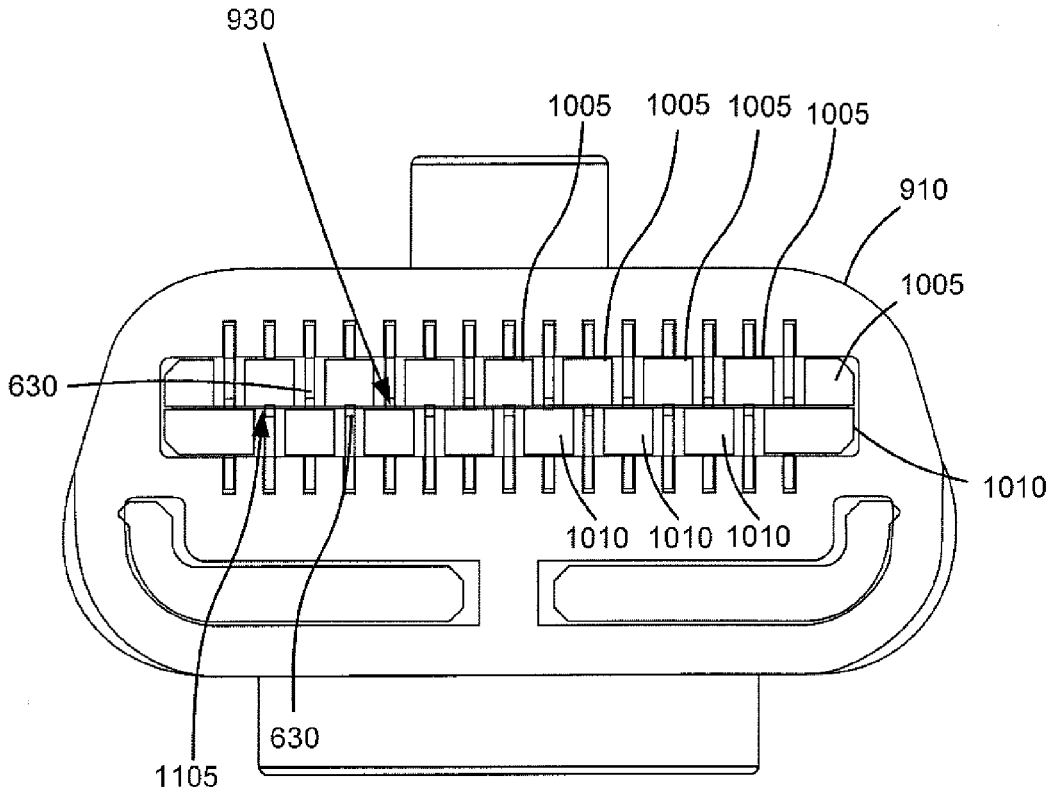
FIG. 12 illustrates a cross-section of the second embodiment of the connector assembly.

Referring to FIG. 12, the guides 1005 of the upper portion 915 may guide a first group of resilient members over contact pads 930 on the upper surface of the circuit 920. The guides 1010 on the lower portion 925 may guide a second group of resilient members over contact pads 1105 on the lower surface of the circuit 920. At least some of the guides 1005 on the upper portion 915 may be positioned so that they are centered over the space defined between the guides 1010 of the lower portion 925. Each guide 1005 and 1010 supports a contact pad 930 and 1105 that is either above or below the guide 1005 and 1010, as the case may be, to enable a secure connection between the contact pad 930 and 1105 and a respective tip portion 630 of a resilient member. In other words, the contact pad 930 and 1105 is effectively "sandwiched" between the respective tip portion 630 and the guide 1005 and 1010.

Figure 13:
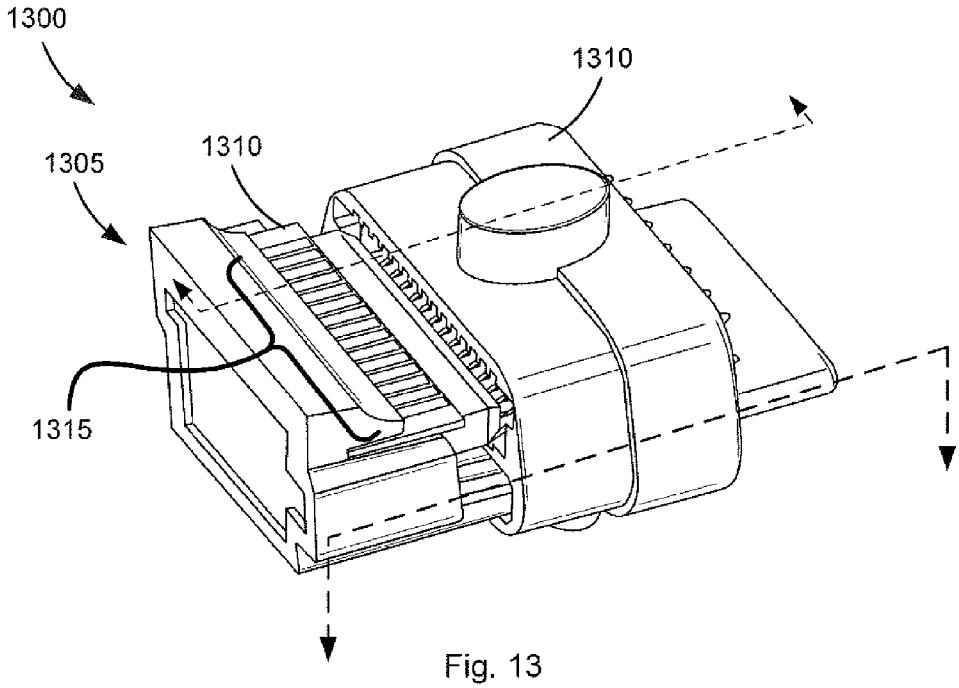
FIG. 13 is a partially exploded view of a third embodiment of a connector assembly.
Figure 14:
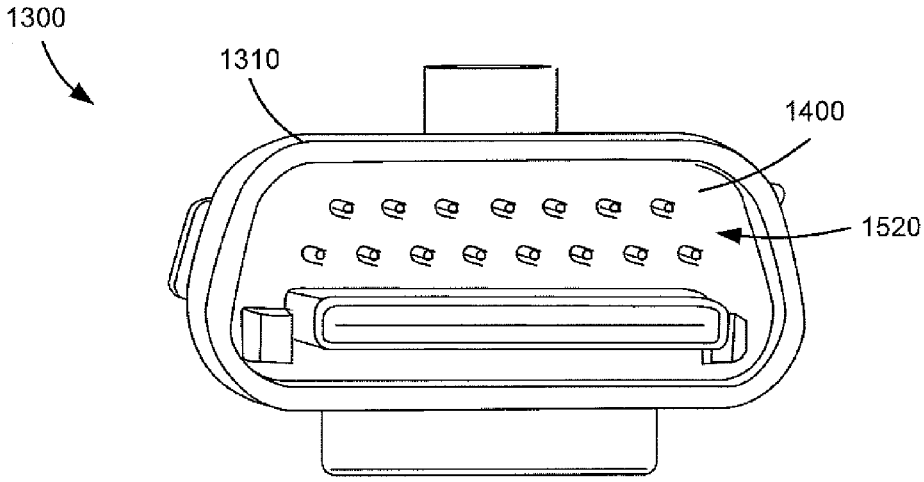
FIG. 14 illustrates a rear view of the third embodiment of the connector assembly.

FIG. 13 illustrates a third embodiment of a connector assembly 1300. The connector assembly 1300 includes an insertion member 1305 and a housing 1310. As described above, the housing 1310 defines an opening at a first end configured to receive the insertion member 1305. An upper inside surface of the housing 1310 and a lower inside surface of the housing 1310 may define a plurality of slots within which are positioned a group of electrical contacts 1500, as more clearly illustrated in FIG. 16.

A rear wall 1400 of the housing 1310 defines a plurality of openings through which mating extensions 1520 of the electrical contacts 1500 (FIG. 15) extend. The openings and mating extensions 1520 may be arranged in rows and may be staggered, as described above.

Figure 15:
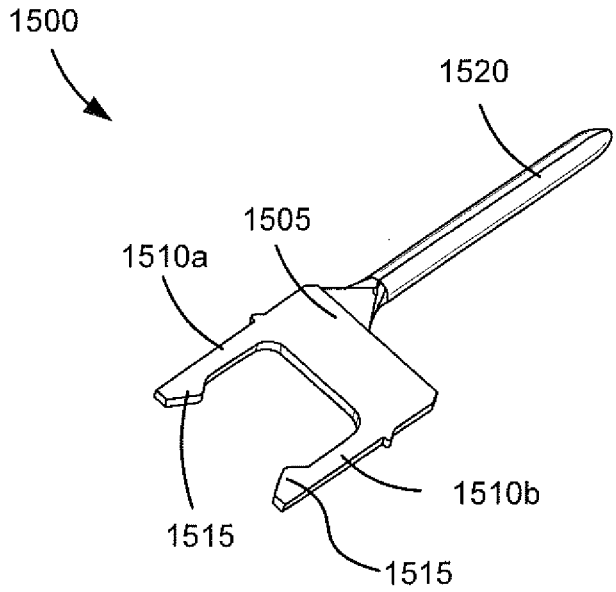
FIG. 15 illustrates an electrical contact of the third embodiment of the connector assembly.

The electrical contacts 1500 are positioned within the opening of the housing 1310 adjacent to one another. Referring to FIG. 15, each electrical contact 1500 includes a cross-member 1505, a first extension member 1510*a*, a second extension member 1510*b*, and a mating extension 1520. The first and second extension members 1510*a* and 1510*b* extend from first and second ends, respectively, of the cross-member and are positioned within respective slots of the housing 1310.

At least one of the first and second extensions members 1510*a* and 1510*b* may be configured as a resilient electrical contact for contacting a contact pad 1315 of the circuit 1310 of the insertion member 1305. The slots of the housing 1310 may be sized to enable the resilient electrical contact to resiliently move within the slots. In other words, the depth of each slot may be increased to enable the resilient electrical contact to move upward within the slot when the insertion member 1305 is inserted in the housing 1310.

Figure 16:
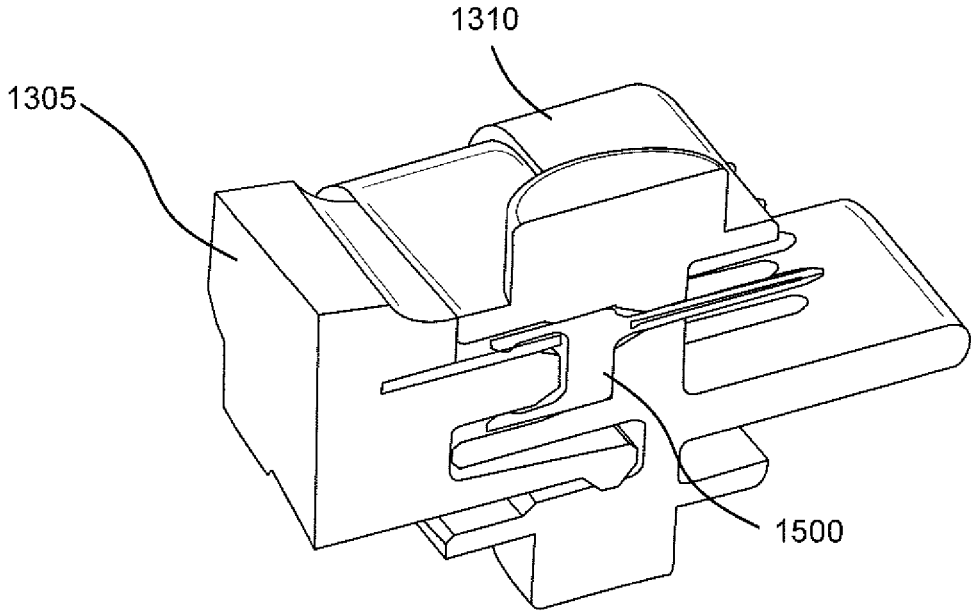
FIG. 16 illustrates a cross-section of the third embodiment of the connector assembly.

Positioned at the end of the resilient member is a contact tip 1515 configured to make electrical contact with the contact pad 1315 of the circuit 1310. The distance between respective tips 1515 of the first and second extension members 1510*a* and 1510*b* is configured to produce a resilient force on the contact pads 1315 when the insertion member 1305 is in a fully inserted state. For example, the distance is configured so that the contact pad 1315 is squeezed by the resilient force produced between the tips 1515 of the extension members 1510*a* and 1510*b* when the insertion member 1305 is inserted into the housing 1310, as illustrated in FIG. 16.

The mating extension 1520 of the electrical contact extends from the cross-member 1505 and is configured to extend through one of the plurality of openings defined in the rear wall 1400 of the housing 1305, as described above. The mating extensions 1520 are offset towards one of the first and the second extension members 1510*a* and 1510*b*.

Figure 17:
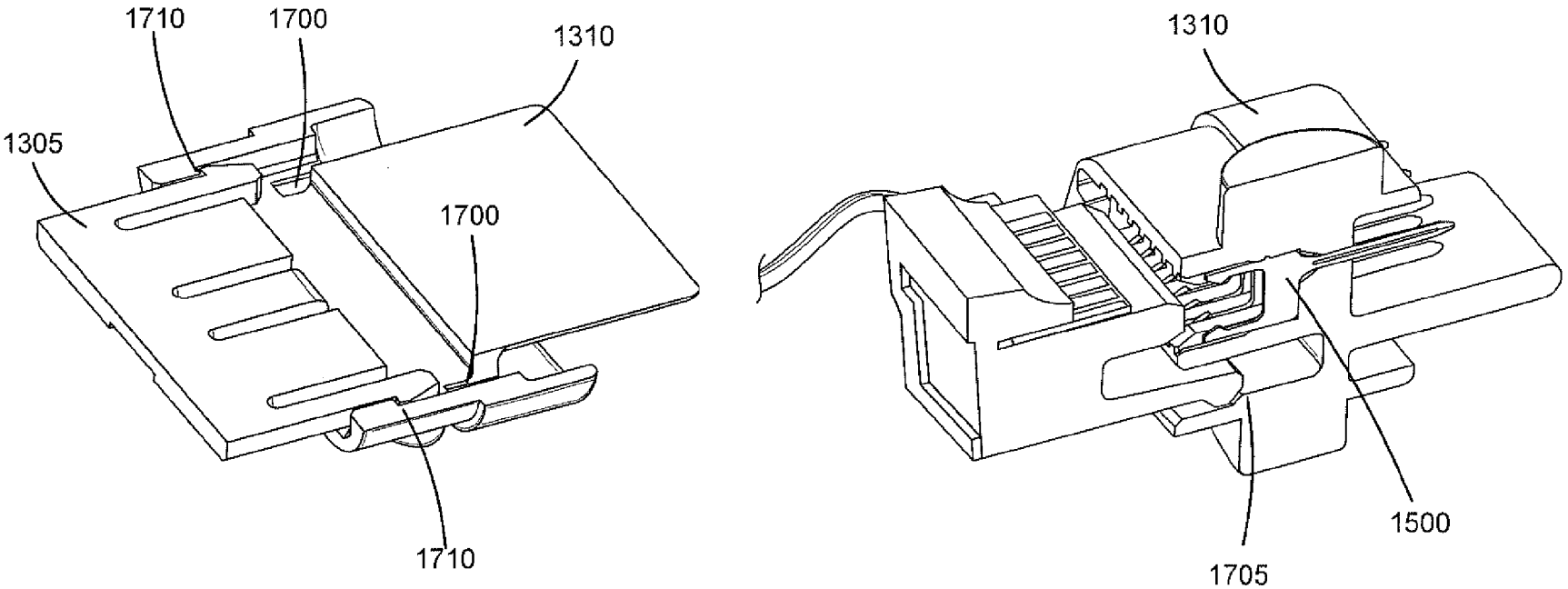
FIG. 17 illustrates internal features of the housing of the third embodiment of the connector assembly.

Referring to FIG. 17, the housing defines first and second slots 1700 and a ridge 1705 on a lower interior surface. An interior side surface of the housing 1310 defines a pair of ledges 1710.

The insertion member 1305 defines a slot in which the circuit is positioned. Although illustrated as single piece, in alternative implementations, the insertion member 1305 may correspond to any insertion member described above. For example, the insertion member 1305 may include upper and lower portions, such as the upper and lower portions 300 and 305 shown in FIG. 3. The insertion member 1305 may include locating features to align the upper and lower portions with the circuit.

Figure 18:
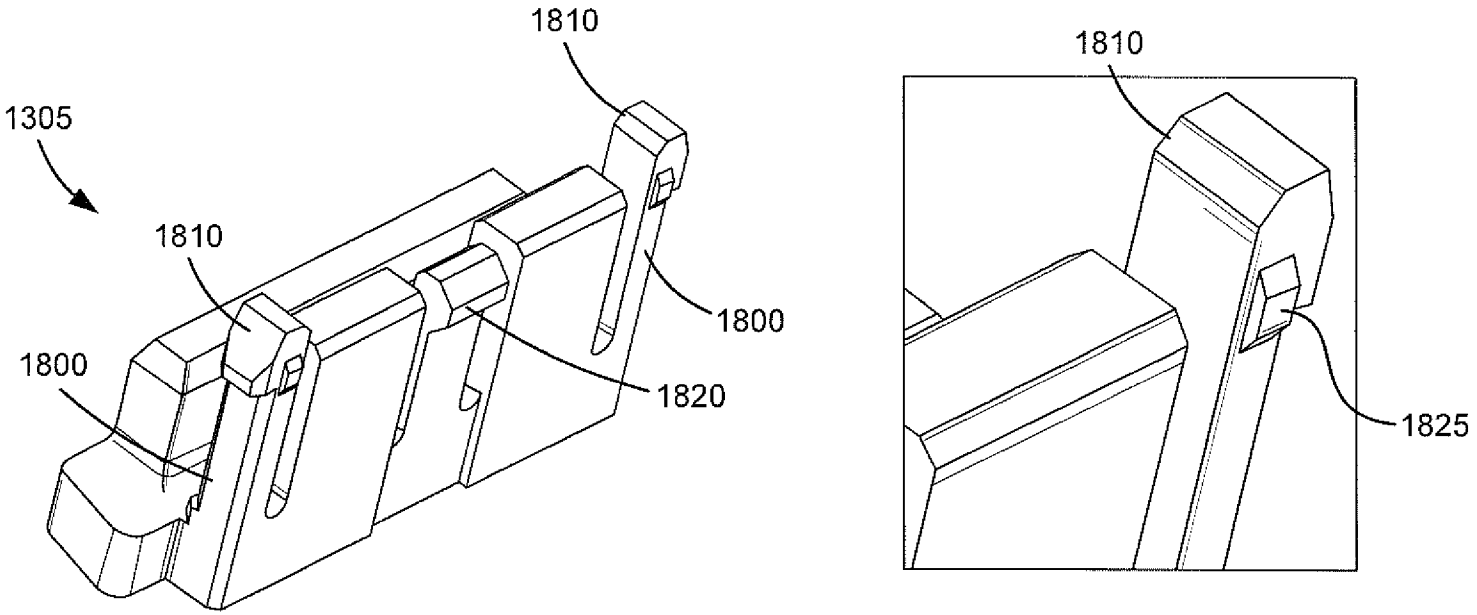
FIG. 18 illustrates the insertion member of the third embodiment of the connector assembly.

Referring to FIG. 18, the insertion member 1305 includes a first and a second resilient finger 1800. The tip 1810 of each resilient finger 1800 is configured as a snap-lock-mechanism that cooperates with the ledge 1710 of the housing 1310 to allow the insertion member 1305 to be inserted into the housing 1310, but not fully removed from the housing 1310 after the insertion member 1305 is partially inserted into the housing 1310. The tip 1810 may also include a protrusion 1825 on a lower surface. The protrusions 1825 on the respective tips 1810 are configured to enter the slots 1700 of the housing 1310 when the insertion member 1305 is fully inserted within the housing 1310. The protrusions 1825 cooperate with the slots 1700 to prevent the insertion member 1305 from being removed once fully inserted within the housing 1310.

In some implementations, the insertion member 1305 also includes a second resilient member 1820. The second resilient member 1820 is configured to contact the ridge 1705 of the housing 1310 to selectably maintain the insertion member 1305 in the partially inserted state.

Referring back to FIG. 13, the insertion member 1305 includes a support surface upon which a circuit 1310 is positioned. The circuit 1310 may be formed as described above and may include a group of contact pads 1315 on a top surface. The insertion member 1305 may define locating features within which the flex is partially positioned.

In operation, the connector assembly 1300 may be assembled by partially inserting the insertion member 1305 within the housing 1310. In this state, the tip 1810 of each resilient finger 1800 cooperates with a respective ledge 1710 defined within the housing 1310 to prevent the insertion member 1305 from being removed. The second resilient member 1820 of the insertion member 1305 cooperates with the ridge 1705 of the housing 1310 to prevent the insertion member 1305 from being unintentionally inserted further within the housing 1310.

Figure 19:
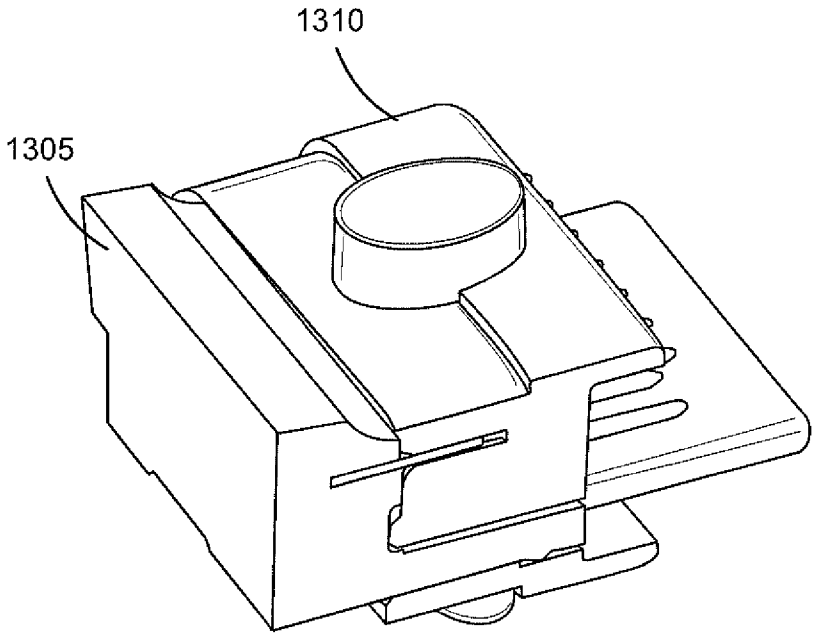
FIG. 19 illustrates a cross-section of the third embodiment of the connector assembly when the insertion member is fully inserted in the housing.

In the partially inserted configuration, the circuit 1310 may be positioned within the slot of the insertion member. To complete assembly, the insertion member 1305 may be fully inserted within the housing 1310 such that the protrusions 1825 on the first and second resilient fingers 1800 engage the slots 1700 defined in the lower surface of the housing 1310, as shown in FIG. 19. Once engaged, the insertion member 1305 is prevented from being removed from the housing 1310.

While various embodiments of the embodiments have been described, it will be apparent to those of ordinary skill in the art that many more embodiments and implementations are possible that are within the scope of the claims. The various dimensions described above are merely exemplary and may be changed as necessary. Accordingly, it will be apparent to those of ordinary skill in the art that many more embodiments and implementations are possible that are within the scope of the claims. Therefore, the embodiments described are only provided to aid in understanding the claims and do not limit the scope of the claims.

What is claimed is:

1. A connector assembly, comprising:

an insertion member that includes a plurality of contact pads;

a housing that defines an opening at a first end configured to receive the insertion member, wherein an upper inside surface and a lower inside surface of the housing define a plurality of slots, and a wall of the housing defines a plurality of openings, said openings being arranged in a first row and a second row, the plurality of openings in the first row and the second row being evenly spaced apart from adjacent openings, and wherein the openings in the first row are staggered in relation to the openings in the second row; and a plurality of electrical contacts positioned adjacent to one another in the first end of the housing, each electrical contact including:

a cross-member;

a first extension member and a second extension member that extend from a first end and a second end, respectively, of the cross-member, wherein the first and the second extension members are positioned within respective slots of the housing;

a resilient member that extends from a first side of the cross-member that is between the first and the second extension members, the resilient member being configured to make electrical contact with a contact pad of the plurality of contact pads of the insertion member; and a mating extension that extends from a second side of the cross-member that is opposite the first side, wherein the mating extension is configured to extend through one of the plurality of openings defined in the wall of the housing.

2. A connector assembly comprising:

an insertion member that includes a plurality of contact pads;

a housing that defines an opening at a first end configured to receive the insertion member, wherein an upper inside surface and a lower inside surface of the housing define a plurality of slots, and a wall of the housing defines a plurality of openings; and a plurality of electrical contacts positioned adjacent to one another in the first end of the housing, each electrical contact being of an identical configuration and including:

a cross-member;

a first extension member and a second extension member that extend from a first end and a second end, respectively, of the cross-member, wherein the first and the second extension members are positioned within respective slots of the housing;

a resilient member that extends from a first side of the cross-member that is between the first and the second extension members, the resilient member being configured to make electrical contact with a contact pad of the plurality of contact pads of the insertion member; and a mating extension that extends from a second side of the cross-member that is opposite the first side, wherein the mating extension is configured to extend through one of the plurality of openings defined in the wall of the housing and each mating extension of each electrical contact is offset from a center of the second side of a respective cross-member, and adjacent electrical contacts positioned in the first end of the housing are rotated 180 degrees relative to one another.

3. A connector assembly comprising:

an insertion member that includes a plurality of contact pads;

a housing that defines an opening at a first end configured to receive the insertion member, wherein an upper inside surface and a lower inside surface of the housing define a plurality of slots, and a wall of the housing defines a plurality of openings; and a plurality of electrical contacts positioned adjacent to one another in the first end of the housing, each electrical contact including:

a cross-member;

a first extension member and a second extension member that extend from a first end and a second end, respectively, of the cross-member, wherein the first and the second extension members are positioned within respective slots of the housing;

a resilient member that extends from a first side of the cross-member that is between the first and the second extension members, the resilient member being configured to make electrical contact with a contact pad of the plurality of contact pads of the insertion member; and a mating extension that extends from a second side of the cross-member that is opposite the first side, wherein the mating extension is configured to extend through one of the plurality of openings defined in the wall of the housing, wherein the plurality of electrical contacts includes a first group of contacts that are of a first configuration where the mating extension is offset towards the first extension member, and a second group of contacts that are of a second configuration where the mating extension is offset towards the second extension member.

4. The connector assembly according to claim 3, wherein the first group of contacts and the second group of contacts are positioned adjacent to each other in the first end of the housing.

5. A connector assembly comprising:

an insertion member that comprises a flexible circuit board upon which a plurality of contact pads are positioned, a first group of contact pads of the plurality of contact pads being positioned on a top surface of the flexible circuit board, and a second group of contact pads of the plurality of contact pads being positioned on a lower surface of the flexible circuit board, the first group of contact pads being staggered in relation to the second group of contact pads;

a housing that defines an opening at a first end configured to receive the insertion member, wherein an upper inside surface and a lower inside surface of the housing define a plurality of slots, and a wall of the housing defines a plurality of openings; and a plurality of electrical contacts positioned adjacent to one another in the first end of the housing, each electrical contact including:

a cross-member;

a first extension member and a second extension member that extend from a first end and a second end, respectively, of the cross-member, wherein the first and the second extension members are positioned within respective slots of the housing;

a resilient member that extends from a first side of the cross-member that is between the first and the second extension members, the resilient member being configured to make electrical contact with a contact pad of the plurality of contact pads of the insertion member; and a mating extension that extends from a second side of the cross-member that is opposite the first side, wherein the mating extension is configured to extend through one of the plurality of openings defined in the wall of the housing.

6. A connector assembly comprising:

an insertion member that comprises a flexible circuit board upon which a plurality of contact pads are positioned, and the insertion member comprising an upper portion and a lower portion, the flexible circuit being positioned in-between the upper portion and the lower portion;

a housing that defines an opening at a first end configured to receive the insertion member, wherein an upper inside surface and a lower inside surface of the housing define a plurality of slots, and a wall of the housing defines a plurality of openings; and a plurality of electrical contacts positioned adjacent to one another in the first end of the housing, each electrical contact including:

a cross-member;

a first extension member and a second extension member that extend from a first end and a second end, respectively, of the cross-member, wherein the first and the second extension members are positioned within respective slots of the housing;

a resilient member that extends from a first side of the cross-member that is between the first and the second extension members, the resilient member being configured to make electrical contact with a contact pad of the plurality of contact pads of the insertion member; and a mating extension that extends from a second side of the cross-member that is opposite the first side, wherein the mating extension is configured to extend through one of the plurality of openings defined in the wall of the housing.

7. The connector assembly according to claim 6, wherein the upper portion and the lower portion define a plurality of guides, where each guide of the upper portion is in-line with a respective guide of the lower portion and a contact pad of the plurality of contact pads, wherein the guides are configured to guide the resilient member over the contact pad when the insertion member is inserted into the housing and to support the contact pad against the resilient member.

8. The connector assembly according to claim 6, wherein the upper portion defines a plurality of guides that define a space there between configured to guide a first group of resilient members over a plurality of contact pads positioned on a top surface of the flexible circuit board, and the lower portion defines a plurality of guides that define a space there between configured to guide a second group of resilient members over a plurality of contact pads positioned on a bottom surface of the flexible circuit board.

9. The connector assembly according to claim 8, wherein at least some guides of the plurality of guides of the upper portion are centered over the space defined between guides of the plurality of guides of the lower portion.

* * * * *